US007010895B2

(12) United States Patent
Bruno

(10) Patent No.: US 7,010,895 B2
(45) Date of Patent: Mar. 14, 2006

(54) DROP CEILING MADE OF WOOD

(76) Inventor: Anthony S. Bruno, 3206 Stump Hall Rd., Collegeville, PA (US) 19426

( * ) Notice: Subject to any disclaimer, the term of this patent is extended or adjusted under 35 U.S.C. 154(b) by 0 days.

(21) Appl. No.: 10/456,758

(22) Filed: May 22, 2003

(65) Prior Publication Data

US 2004/0231271 A1 Nov. 25, 2004

(51) Int. Cl.
*E04B 2/00* (2006.01)

(52) U.S. Cl. ..... 52/506.06; 52/506.07; 52/22; 52/506.08

(58) Field of Classification Search ..... 52/506.06, 52/506.05, 506.09, 763, 762, 775, 780, 506.07, 52/22

See application file for complete search history.

(56) References Cited

U.S. PATENT DOCUMENTS

| | | | | | |
|---|---|---|---|---|---|
| 3,251,164 | A | * | 5/1966 | Wright | 52/283 |
| 3,375,630 | A | * | 4/1968 | Dail | 52/506.08 |
| 3,470,666 | A | * | 10/1969 | Bobzin et al. | 52/506.08 |
| 3,473,282 | A | * | 10/1969 | Wilbourn, Jr. | 52/664 |
| 4,281,498 | A | | 8/1981 | Kern | 52/780 |
| 4,367,616 | A | | 1/1983 | Pearson | 52/664 |
| 4,464,876 | A | | 8/1984 | Kern | 52/484 |
| 4,525,971 | A | * | 7/1985 | Kern | 52/506.06 |
| 4,773,200 | A | * | 9/1988 | Young | 52/506.06 |
| 4,841,709 | A | | 6/1989 | Peterson et al. | 52/664 |
| 5,218,808 | A | | 6/1993 | Ardley | 52/484 |
| 5,239,801 | A | | 8/1993 | Adams | 52/484 |
| 5,261,204 | A | | 11/1993 | Neff | 52/484 |
| 5,349,796 | A | * | 9/1994 | Meyerson | 52/309.11 |
| 6,079,177 | A | | 6/2000 | Halchuck | 52/506.06 |

FOREIGN PATENT DOCUMENTS

| | | | |
|---|---|---|---|
| DE | 3813965 | A1 * | 12/1988 |
| JP | 04189952 | A * | 7/1992 |

* cited by examiner

*Primary Examiner*—Kimberly Wood
(74) *Attorney, Agent, or Firm*—Mark A. Garzia, P.C.; Mark A. Garzia

(57) ABSTRACT

A ceiling, preferably made of wood, to be suspended from an existing ceiling of a room comprising a plurality of perimeter support members adapted to be attached to antipode walls of the room. The perimeter supports having a rabbit channel along their top edge. The suspended ceiling including a center beam having inner side and an outer side, the inner side designed to face the interior of the room, the outer side of the center beam having a pair of channels extending along the longitudinal dimension of the center beam, a brace designed to attach to the outer side of the center beam for fixedly attaching the center beam in a pre-determined location to the ceiling, and a plurality of ceiling panels designed to extend from (and supported by) the perimeter supports and the center beam. Each ceiling panel has at least one rail attached to the front side for communicating with a rabbit joint on the perimeter supports for securing the ceiling panel. If the ceiling panel has a second rail, it is used to communicate with the channel on the center beam further restricting movement of the ceiling panel.

16 Claims, 7 Drawing Sheets

DROP CEILING MADE OF WOOD

FIELD OF THE INVENTION

This invention relates generally to indoor ceilings and, more particularly, to suspended ceilings made of wood.

BACKGROUND OF THE INVENTION

Suspended ceilings (sometimes referred to as drop ceilings) for indoor use are well known in the art. Suspended ceilings are usually used in areas where pre-existing utility equipment is found and cannot easily be relocated. For example, many buildings (commercial and residential) have duct work, electrical wires, gas and water pipes strung near the ceilings of each floor (or below each floor). In order to preserve access to this equipment (i.e., for maintenance) they are usually left exposed either completely or partially and are hidden by a suspended ceiling. In other areas, where floor space is at a premium, it may be desirable to finish the ceiling quickly and inexpensively by using a suspended ceiling.

Typical suspended ceilings consist of aluminum dividers suspended from the existing ceiling by wires and pre-formed panels made from recycled products. A drawback of these typical drop ceilings is that there is very little diversity in the ceiling panels and the aluminum dividers. The aluminum dividers are typically white. The panels are usually also white in color and have an irregular (similar to the appearance of plaster) texture. Also, the panels are damaged easily and tend to turn yellow over time.

Drop ceilings made of wood are also known. For example, Kern U.S. Pat. No. 4,464,876 discloses a suspended wood beam ceiling and related mounting hardware used to support the various wood beams. Kern discloses the use of translucent light panels or decorative opaque panels suspended between the wood beams to enhance the appearance and/or match the decor of the room.

SUMMARY OF THE INVENTION

The present invention is a drop ceiling system made of wood. In one embodiment, the present invention has perimeter supports along the walls and a single center beam to support a plurality of ceiling panels. A cleat is attached on at least one side of each ceiling panel which communicate with a joint formed on the perimeter supports to secure the panels to the perimeter support and prevent the accidental displacement of the wood panels.

The present invention allows the ceiling panels to be quickly replaced to change the appearance of the room or area.

BRIEF DESCRIPTION OF THE DRAWINGS

The accompanying drawings, which are incorporated in and form a part of the specification, illustrate the embodiments of the present invention and, together with the following description, serve to explain the principles of the invention. For the purpose of illustrating the invention, there are shown in the drawings embodiments which are presently preferred, it being understood, however, that the invention is not limited to the specific instrumentality or the precise arrangement of elements or process steps disclosed.

In the drawings.

DETAILED DESCRIPTION OF THE PREFERRED EMBODIMENT

In describing a preferred embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Preferred embodiments of the present invention will now be described in detail with reference to the accompanying drawings in which a suspended wood ceiling in accordance with the present invention is generally indicated at 10.

Figure 1:
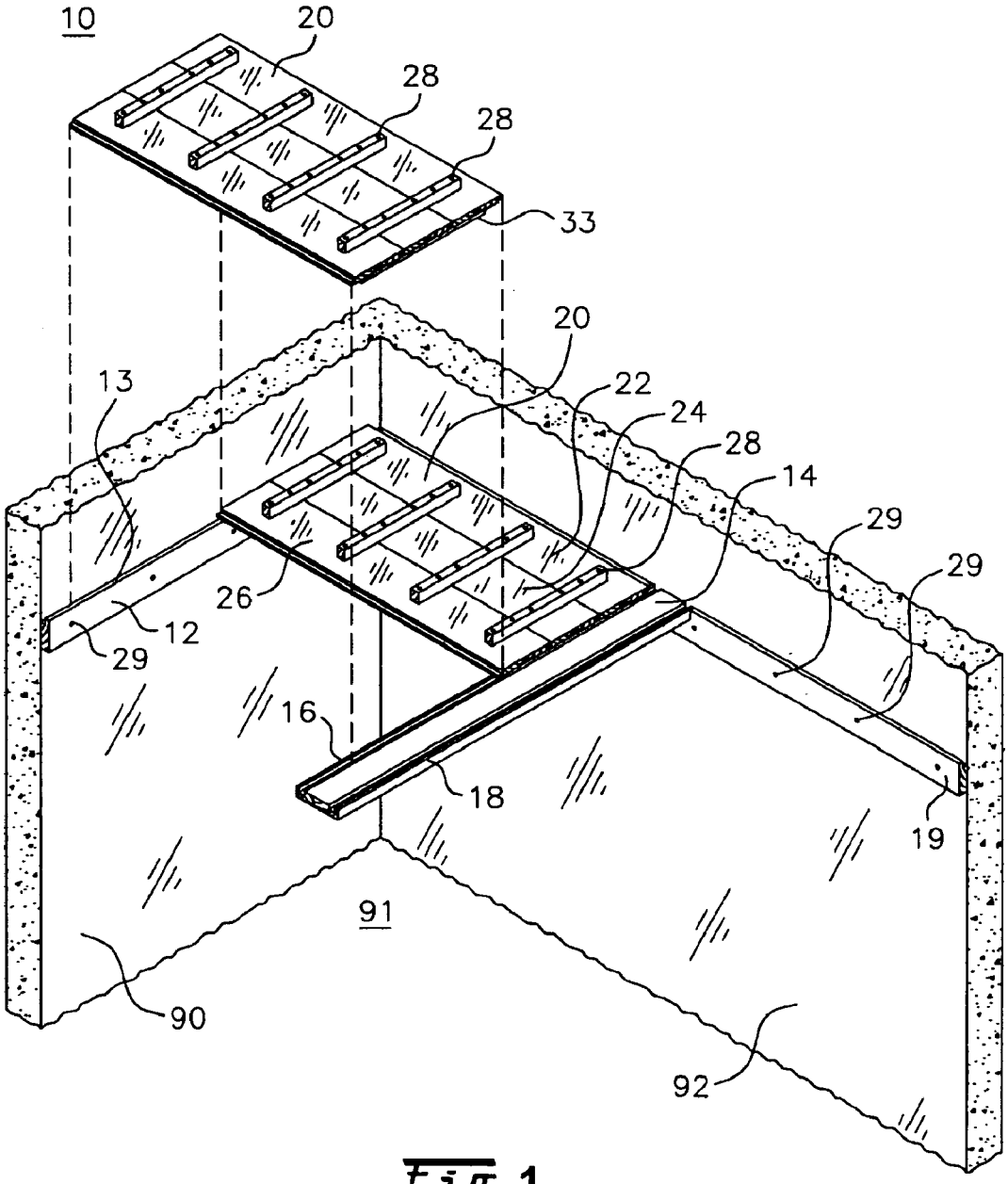
FIG. 1 is an back isometric view of a suspended wood ceiling in accordance with the present invention, with parts broken away and parts taken in section, showing a ceiling panel in projected position.
Figure 3:
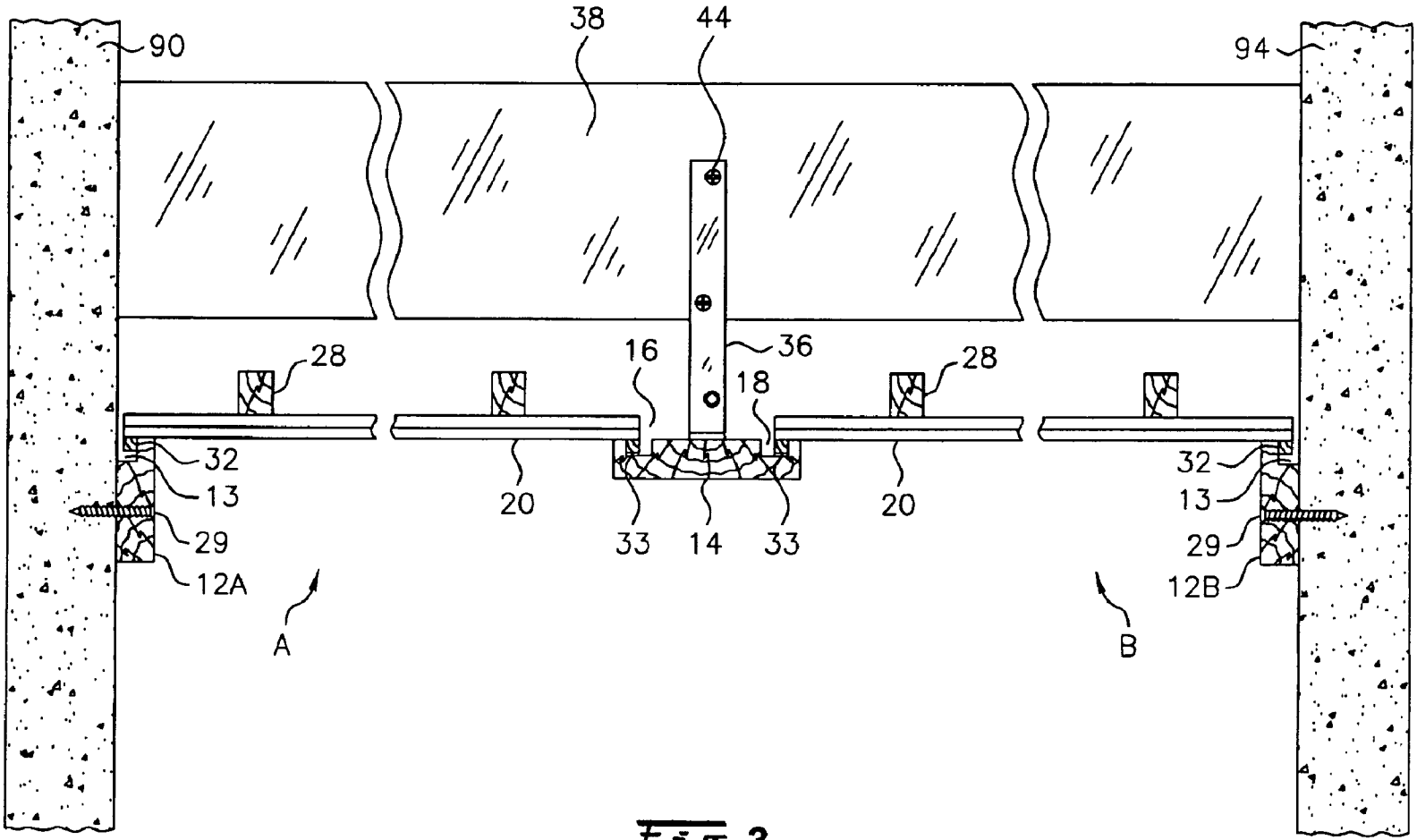
FIG. 3 is and enlarged section view of a suspended wood ceiling in accordance with the present invention for a room that can be spanned with two rows of ceiling panels and one center beam.

Referring to FIG. 1, two interior walls 90, 92 of a room, shown in section, are illustrated. Although the present invention may be adapted for use in a variety of sized and shaped rooms, the present description will assume that the room is rectangularly-shaped having four walls that meet at substantially right angles. As shown in FIG. 3, third wall 94 is an antipode to wall 90; an antipode of wall 92 is not shown. Although not illustrated, all four walls of the room including walls 90, 92 and their respective antipodes extend upwards from a floor 91 to a ceiling.

The ceiling (especially one in the basement of a house) is usually the underside of a floor on the immediate upper level. Directly below the floor are joists which support the floor. Electrical and telephone wires, plumbing, duct work and similar features are strung on, through and under the joists. The joists, wires, plumbing and duct work are exposed and visible to an observer in the basement.

At least one weight-bearing side beam 12 (sometimes referred to as a perimeter support) is attached to the first wall 90 and a similar number of weight-bearing side beams 12 are attached to the opposite wall 94. In a preferred embodiment, dry wall screws 29, nails or similar means are used to secure perimeter supports 12. A number of well-known devices (e.g., butterfly bolts for a concrete wall) may also be used depending on the material used to construct the wall. The choice of which type of attachment means to secure the perimeter supports 12 to the walls will depend on several factors including preferences of the installer, the type of walls in the room (e.g., drywall, plaster, concrete blocks, etc.), the size and weight of the wooden ceiling panels, and, to a lesser extent, the size of the room.

A center beam 14, non-weight-bearing side beams 19 and a plurality of ceiling panels 20 complete the major components of a suspended wood ceiling in accordance with the present invention. As will be more fully described hereafter, the weight of the plurality of ceiling panels is borne by the perimeter supoort 12 (sometimes also referred to as weight-bearing side beams 12) and the center beam 14.

Since it is assumed that the entire ceiling will be covered by the suspended wood ceiling 10, the perimeter supports 12 are attached along the entire length of two diametrically opposed walls 90, 94 in the room as illustrated in FIG. 3. Unless some special effect is trying to be achieved, the perimeter supports 12 are leveled when they are attached to the walls 90, 94. Each perimeter support 12 has a rabbit joint 13 which will be fully described later herein in connection with FIG. 7.

If the room is small enough (or if a single perimeter support 12 is long enough) one perimeter support can span an entire wall. However, since it will be preferable to standardize the length of the perimeter supports 12, two or more perimeter supports 12 (and possibly even a partial perimeter support) will usually be required to span one wall.

In one embodiment, it may be desirable to standardize the length of the perimeter supports at five feet. For a wall that is eleven feet long, two perimeter supports 12 plus a third perimeter support cut to one foot in length would be needed.

Figure 2:
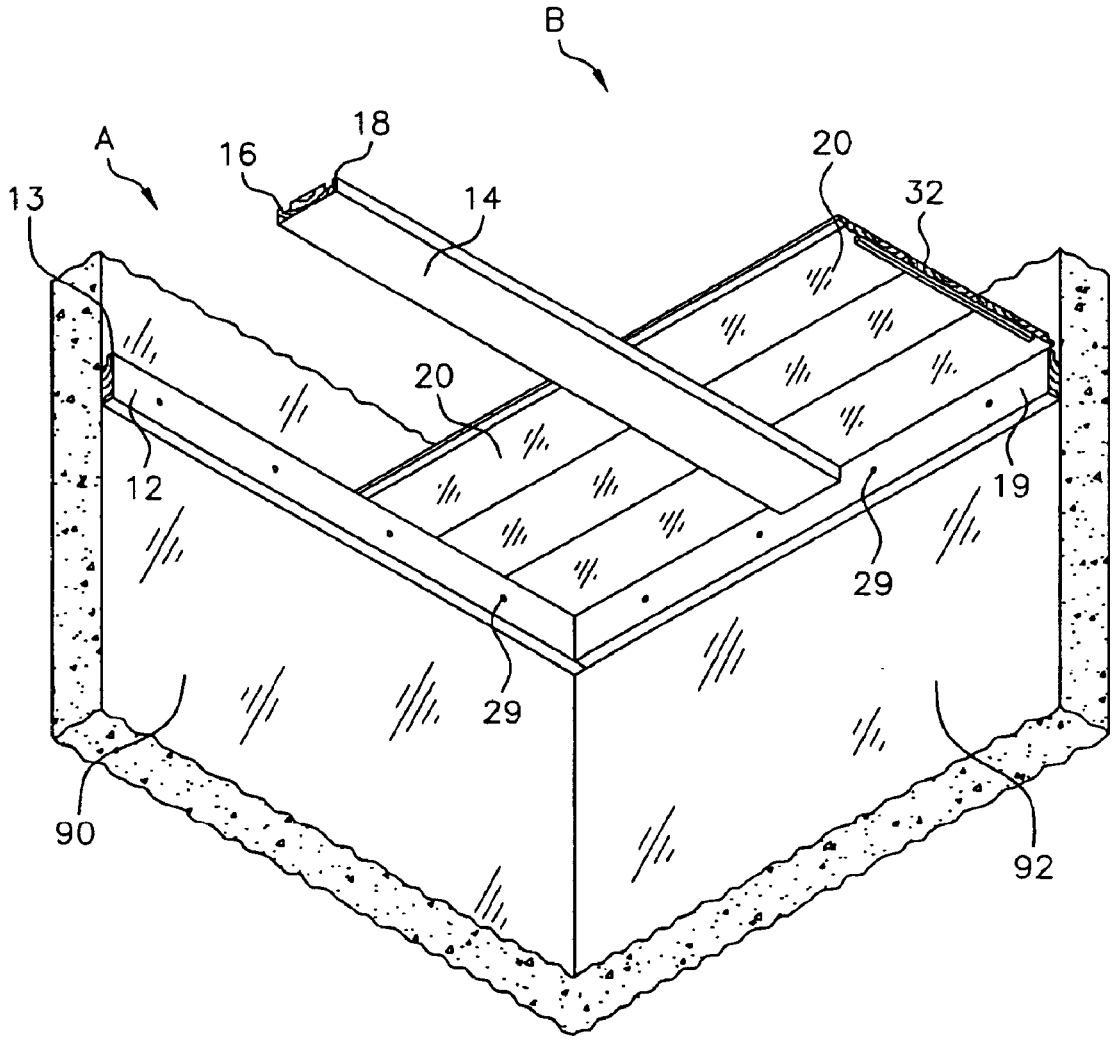
FIG. 2 is a front isometric view of a suspended wood ceiling in accordance with the present invention with parts taken in section, showing two ceiling panels in projected position-one each on either side of the center beam.

Referring now to FIG. 2, the non-weight-bearing side beams 19 are attached to the remaining diametrically opposed side walls of the room. The non-weight-bearing side beams 19 are for decorative purposes and are not needed to support the weight of the ceiling panels 20. Non-weight-bearing side beams 19 have the same outer appearance as the perimeter supports or weight-bearing side beams 12; however, they do not require a rabbit joint 13. The non-weight-bearing side beams 19 are used to give the same fit, appearance and finish to the ceiling as given by the weight-bearing side beams 12. (It would be apparent to one skilled in the art, after a thorough reading of the present disclosure, that weight-bearing side beams 12 can be used on all four walls, just that on two walls the rabbit joint will not be used.)

The non-weight bearing beams 19 are preferably leveled and placed even to the perimeter supports 12. The distance the perimeter supports 12 and the non-weight bearing beams 19 are spaced down from the unfinished ceiling will depend on the location of the duct work, wires and plumbing, and the overall height of the room. If the room is sufficiently high, the perimeter supports 12 and the non-weight bearing beams 19 may be spaced upwards from the floor (for example, to achieve an eight-feet high "standard" ceiling).

Referring again to FIGS. 1 and 2, the center beam 14 is suspended from the existing ceiling of the room. The means for attaching the center beam 14 will be described later herein. The center beam 14 is designed to extend from the second wall 92 to a wall (not shown) diametrically opposed to the second wall 92. The center beam 14 runs substantially parallel to the first wall 90, the third wall 94 and to perimeter supports 12; the center beam 14 would then be substantially perpendicular to the non-weight bearing beams 19.

Referring to FIG. 3 again, a cross-sectional view of the suspended ceiling system 10 in accordance with the present invention is illustrated. In a typical room, only one center beam 14 is required. For example, in a ten feet by twelve feet sized room (i.e., ten feet between first wall 90 and its antipode 94, and twelve feet between second wall 92 and its respective antipode), only one center beam 14 and two columns A, B of ceiling panels 20 are required. In this example, the center beam 14 is truly in the center of the room (i.e., about five feet from wall 90 and five feet from wall 94) and it physically divides the room in half.

Continuing to refer to FIG. 3, the center beam 14 is designed to support a portion of the weight of the plurality of ceiling panels 20 in column A and a portion of the weight of the plurality of ceiling panels 20 in column B. Weight-bearing side beam 12A supports a portion of the weight of the plurality of ceiling panels in column A, while weight-bearing side beam 12B supports a potion of the weight of the plurality of ceiling panels in column B. (It should be noted that side beam 12A is substantially identical to side beam 12B; the different reference numerals are used to distinguish the beam 12A proximate column A from the beam 12B proximate column B.)

Center beam 14 is designed to bear a portion of the weight of the two columns of ceiling panels 20 located on either side of center beam 14. Although it is called a "center" beam, there may be more than one "center" beam 14 if the room is large enough. They are referred to as "center" beams because in a typical room, only one beam 14 will be needed (i.e., in the center of the room) with two rows of ceiling panels 20.

For example, if the room is large, the installer of the present ceiling system 10 may decide to use one center beam 14 and two columns of ceiling panels to cover the entire ceiling. However, the installer may decide to use two "center" beams 14, in which case, three columns of ceiling panels 20 will be required. Similarly, if the installer calls for three center beams, then four columns of ceiling panels will be required, and so on.

In a preferred embodiment, the face of the center beam (i.e., the portion that will be seen from inside the room) will be stained, painted, carved and/or machined to match the fit and appearance of perimeter supports 12 and weight-bearing beams 19.

The center beam 14 may be flat on their back sides (i.e., the side facing the unfinished ceiling) in one embodiment. In another embodiment, each center beam 14 has two channels 16, 18 that run parallel to the longitudinal dimension (i.e., length) of the center beam 14, and along the entire length of the center beam. The purpose of these channels 16, 18 will be discussed further hereinafter.

Referring again to FIGS. 1 and 2, a ceiling panel 20 is designed to extend from the perimeter support 12 to the center beam 14. The ceiling panel 20 usually just lays on top of, or appears to lay on top of, non-weight-bearing side beams 19. Although the non-weight-bearing side beams 19 are not intended to hold any weight, they can clearly support a small fraction of the weight of the ceiling panels in which they come in contact.

If the center beam(s) 14 do not have channels 16, 18, the ceiling panels will also lay flat on the center beam 14; however, the center beam must carry at least part of the weight of the ceiling panels regardless of whether channels 16, 18 are present.

In a ten feet by twelve feet room, the center beam 14 is placed substantially in the middle of the room between the walls 90, 94 (i.e., five feet from wall 90 and five feet from wall 94). In this example, the ceiling panels 20 are approximately two feet wide by five feet long (or more precisely, five foot minus about one-quarter of the width of the center beam). This ensures that each ceiling panel 20 has the length to extend from a weight-bearing side beam 12 to the center beam 14.

Again, using the example of a ten feet by twelve feet room and one center beam 14, if the ceiling panels are two feet in width, it will take six ceiling panels to cover one column (or one half of the ceiling A) and an additional six ceiling panels to cover the remaining column (or the other half of the ceiling B). In this example (i.e., a ten by twelve room with two by five ceiling panels), a total of twelve ceiling panels will be required.

In another example, if the room is fifteen feet by twelve feet in dimension, one may decide to use one center beam 14 at the seven and half foot mark with two columns of ceiling panels 20, wherein each ceiling panel is seven and half feet long. In the alternative, two "center" beams 14 may be used, placing the first center beam at the five feet mark and the second center beam at the ten feet mark, while the ceiling panels 20 are five feet in length. (It should be noted that in this last example, the ceiling panels 20 are the same width and length as the ceiling panels in the ten feet by twelve feet room example. It would be a manufacturing advantage to standardize the sizes of most of the components including the ceiling panels.)

Of course, in the example of a 15' by 12' room with two center beams, three columns of ceiling panels will be required to cover the entire ceiling. Column A would extend from weight bearing side beam 12 on first wall 90 to the first center beam, column B would extend from the first center beam to the second center beam, and column C would extend from the second center beam to the weight-bearing side beam 12 on wall 94.

It will be apparent to one skilled in the art, after reading the present disclosure, to design the suspended ceiling in such a way to suit a particular need, to accommodate the installer, to accommodate the existing ceiling or to minimize the amount of material (e.g., wood) required to cover the ceiling.

Figure 4:
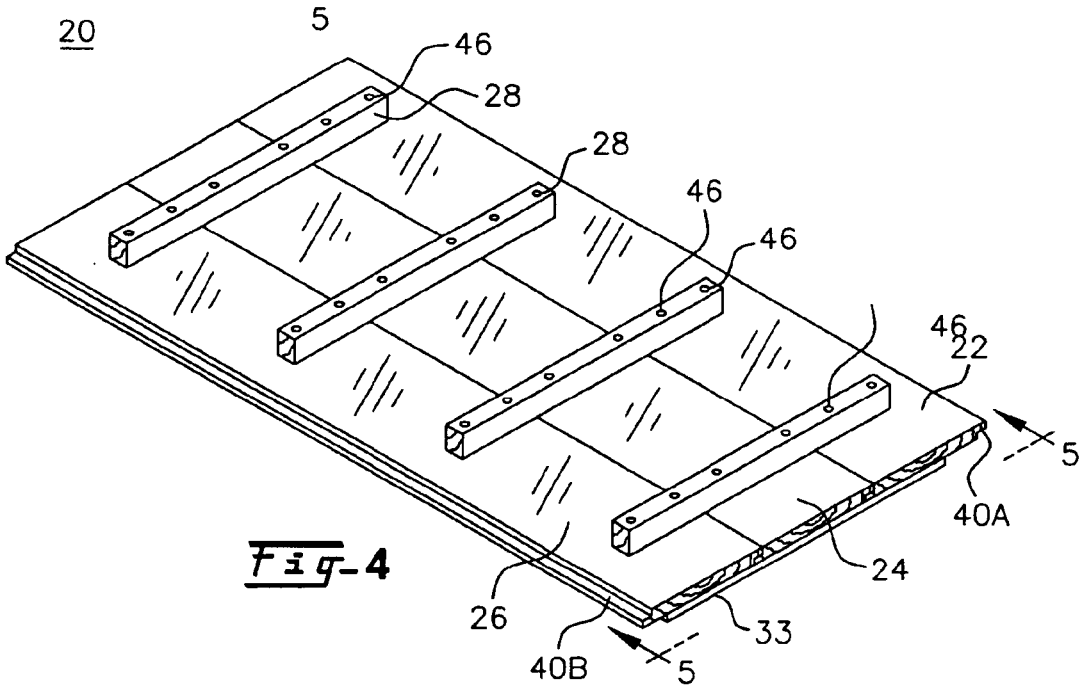
FIG. 4 is a back isometric view of a typical rectangularly-shaped ceiling panel.
Figure 5:
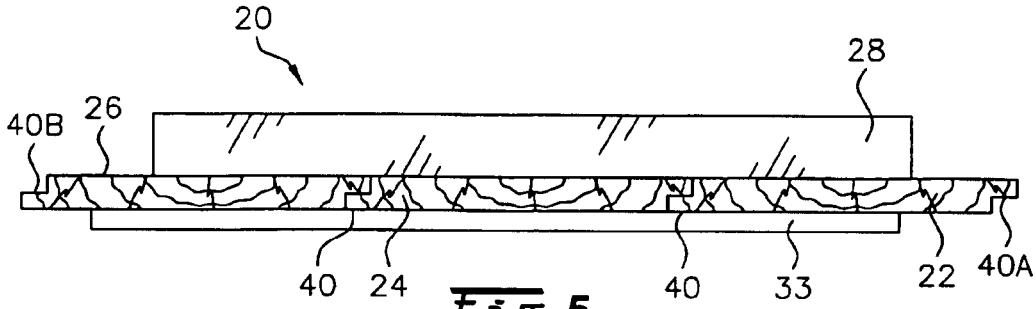
FIG. 5 is an enlarged end view of the ceiling panel illustrated in FIG. 4 taken along line 5—5.
Figure 4B:
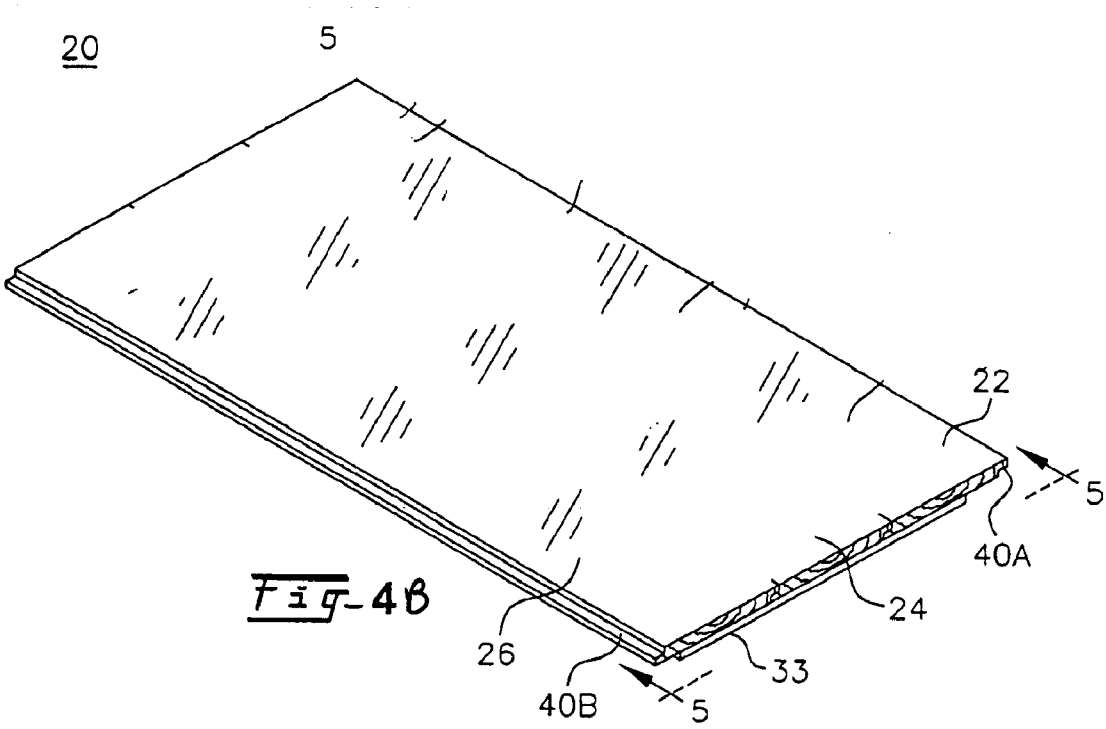
FIG. 4B is a back isometric view of a ceiling panel made from a single piece of wood.

Referring now to FIGS. 4 and 5, in a preferred embodiment, each ceiling panel 20 is made from three flat boards 22, 24, 26, having a lap joint 40 construction along their edges. A top lap 40A on one flat board would mate with the bottom lap 40B of an adjacent flat board.

The ceiling panels 20 and/or each flat board 22,24,26 are preferably made of wood. However, almost any man-made product may be used to manufacture the ceiling panels 20, including wood laminates and plastic-based solid surface material (e.g., CORIAN®).

A plurality of support members 28 are used to secure the three flat boards 22, 24, 26 together into a single ceiling panel 20. In a preferred embodiment, the support members 28 are made of wood but can be made from plastic, metal or any material that can provide the necessary strength to maintain the rigidity of the ceiling panels.

A plurality of wood screws 46 are used to attach support member 28 to the back side of the ceiling panels 20. It would be obvious to one skilled in the art, after reading the present disclosure, to make the ceiling panels using a number of different construction methods and techniques. For example, the lap joint construction is not necessary; some people believe that a tongue-and-groove construction, biscuit joint or other construction gives the ceiling a more professional and finished appearance.

Figure 7:
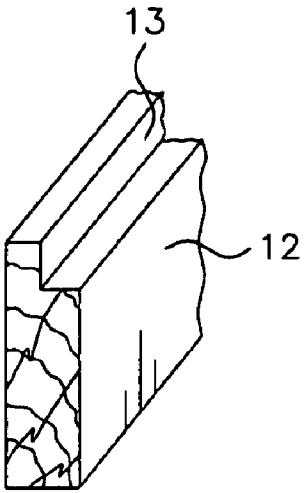
FIG. 7 is an enlarged section view of a side beam illustrating a rabbit joint.

Referring again to FIGS. 4 and 5, a rail 32 is added to the face of each ceiling panel 20. The rail 32 is designed to communicate with rabbit joint 13 of the perimeter supports 12 as illustrated in FIGS. 3 and 7.

Second rail 33 is secured to the opposite end of the ceiling panels 20 and are designed to communicate with channel 16 (or channel 18 depending on which column the ceiling panel is placed) of the center beam 14. The second rail 33 is spaced away from the first rail 32 so that when first rail 32 is inserted into rabbit joint 13 second rail 33 is inserted into channel 16.

When one rail or both rails are properly seated, they are designed to limit the linear movement in one direction and the rotational movement of the ceiling panels. This resists the accidental displacement of the ceiling panels 20.

A feature of the present invention is that the total appearance of the room may be changed by replacing a few (or all) of the ceiling panels with new ceiling panels. Also, the original ceiling panels may be altered by painting, staining or changing the appearance of the ceiling panels by drilling/carving/machining various designs into the wood or forming a specific pattern into the ceiling panels. Moreover, individual flat boards (22, 24 or 26) may be altered instead of changing the entire ceiling panel.

Figure 6:
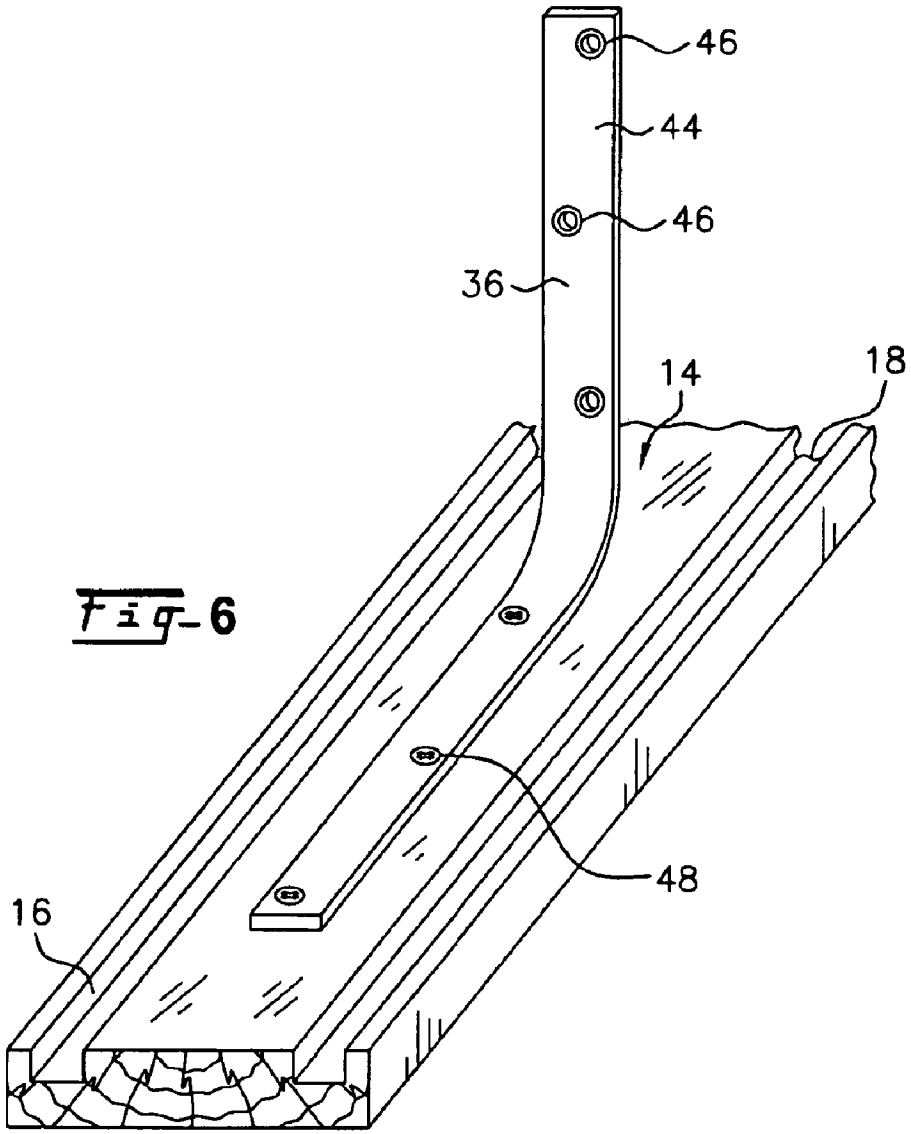
FIG. 6 is an isometric view of the center beam attached to an L-shaped bracket used to secure the center beam.

Referring again to FIG. 3, perimeter supports 12 are shown mounted on their respective diametrically opposed walls 90, 94. Support joists 38 from the existing non-finished ceiling are shown running perpendicular to the center beam 14 and weight-bearing side beams 12. One or more L-shaped brackets 36 are attached to the back side of the center beam 14 and suspended from the support joists 38. A better view of an L-shaped bracket is shown in FIG. 6.

The direction in which the center beam 14 and the weight-bearing side beams 12 ultimately run will depend on an analysis of the room, including the type of pre-existing ceiling, location of pipes, HVAC duct work, and electrical wires, the location and position of support joists, and similar factors.

Figure 6B:
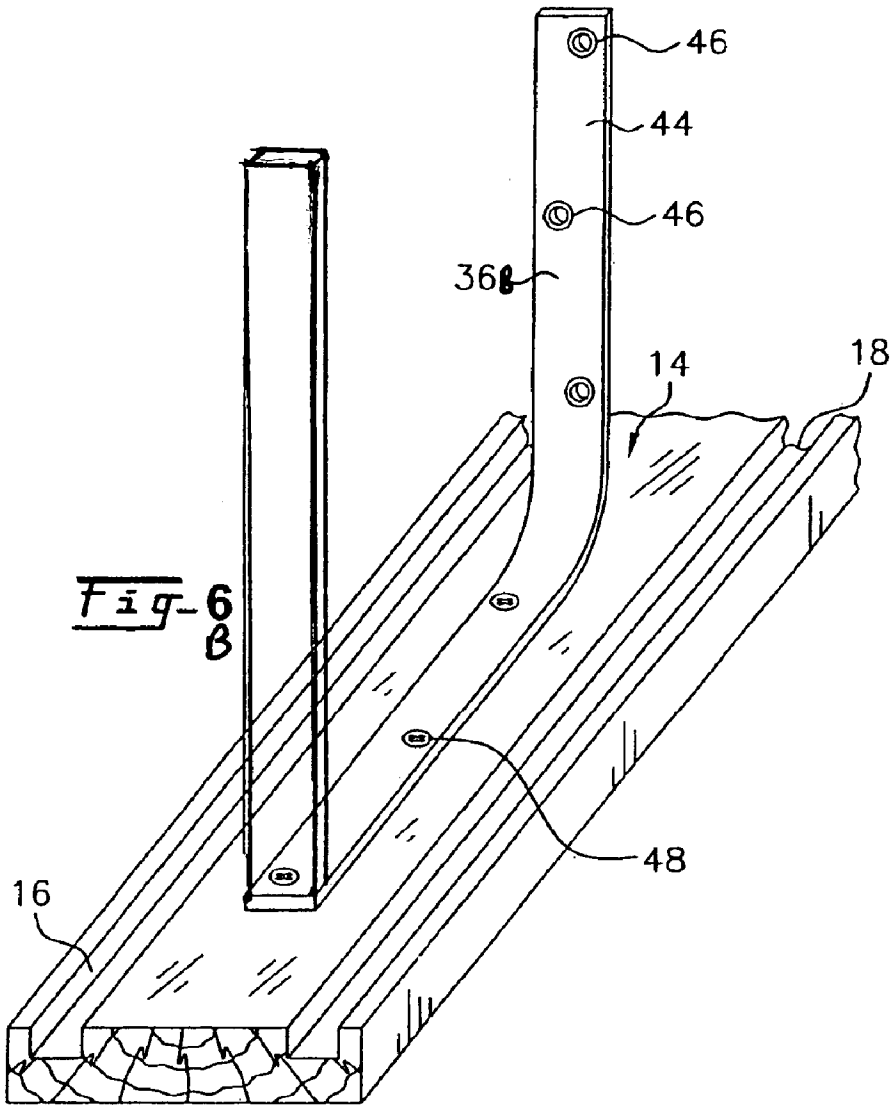
FIG. 6B is an isometric view of a U-shaped bracket used to secure the center beam.

FIG. 6B illustrates a U-shaped bracket 36B.

The L-shaped brackets 36 are particularly desirable to support the center beam 14 when the center beam 14 is designed to hang perpendicular to joists 38. If the joists 38 are made of wood, screws 44 or nails may be used to secure the L-shaped brackets 36 to the joists 38.

The suspended ceiling system 10 should be laid out by the installer initially. Some of the decisions that need to be made by the installer are which walls the weight-bearing beams 12 will be attached, the number of center beams, the approximate location/orientation of the center beams 14 and the size and number of ceiling panels 20 needed to cover the ceiling. The non-weight bearing beams 19 will be secured to the remaining two diametrically opposed walls.

Although ceiling panels 20 are shown with two rails 32, 33, in a preferred embodiment each ceiling panel only requires one rail 32 for communicating with the rabbit joint 13 in perimeter supports 12. One end of the ceiling panel is meant to be raised and at least partially maneuvered above the center beam 14; the remaining end is raised while simultaneously sliding the remaining end back over the perimeter supports 12 so that first rail 32 aligns with and drops into rabbit joint 13.

In another embodiment, the ceiling panels 20 may be equipped with a second rail 33 on the side opposite first rail 32. The second rail 33 is designed to communicate with either channel 16 or channel 18. In this embodiment, the second end of each center panel 20 is slid above and over the center beam 14, the first end is then raised above the perimeter support 12, the entire ceiling panel is then slid back towards the perimeter support 12 until first rail 32 is above and dropped into rabbit joint 13, while the second rail 33 drops into its respective channel 16. The combination of the first rail 32 and rabbit joint 13 along with the combination of the second rail 33 and the channel 16 "locks in" the ceiling panel.

The rails 32, 33 do not necessarily have to carry a significant amount of weight. However, the rails may be subject to a perpendicular or rotational force when someone attempts to move the ceiling panels 20. The rails 32, 33 are typically made of wood but may be manufactured from the same materials as the support members 28. Depending on the materials used to manufacture the rails, they may be attached to the flat boards by wood screws, tacking, gluing or other means known in the industry.

As indicated previously, the ceiling system 10 preferably utilizes only one rail 32. However, this one rail is sufficient to prevent the accidental displacement of the ceiling panels. A second rail 33 will further secure each ceiling panel so that only an intentional manipulation (and in a specific manner also) of the ceiling panel will dislodge it.

The use of one or both rails is an important feature of this invention. The ease of installation and the ease of changing the appearance of the entire ceiling system by replacing or manipulating a few flat boards are other features.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

I claim:

1. A ceiling suspended from an existing ceiling of a room, the room including first and second pairs of antipode walls and joists that support the existing ceiling, the suspended ceiling comprising:

a plurality of perimeter supports, each perimeter support having a front side, a back side, a top and bottom, the front side designed to face the interior of the room, the back side being secured against the first pair of antipode walls, the top of each perimeter support having a rabbit joint, said perimeter supports running substantially the entire length of the first pair of antipode walls;

at least one center beam having an inner side and an outer side, the inner side designed to face the interior of the room while the outer side faces the existing ceiling, the center beam running substantially parallel to said perimeter supports;

a brace attached to the center beam for fixedly attaching the center beam in a pre-determined location to the ceiling; and a plurality of rectangularly-shaped ceiling panels, each ceiling panel having an outer side that faces the existing ceiling and an inner side that faces the interior of the room, the ceiling panels designed to extend from at least one perimeter support to the center beam;

a first rail attached on the inner side of each ceiling panel and along the edge of each ceiling panel that contacts its respective perimeter support, said first rail adapted to communicate with said rabbit joint on the perimeter support for restricting movement of the ceiling panel and ensuring the ceiling panel remains in place, said perimeter supports and said center beam bearing the weight of the ceiling panels.

2. The suspended ceiling of claim 1 further comprising a plurality of non-weight bearing side members designed to be mounted on the second pair of antipode walls and matching the appearance of the perimeter supports for giving the ceiling a more finished look.

3. A The suspended ceiling of claim 1 wherein the brace is designed to attach to the outer side of the center beam.

4. The suspended ceiling of claim 3 wherein the center beam and the perimeter supports run substantially perpendicular to the joists.

5. The suspended ceiling of claim 4 wherein the brace is an L-shaped bracket designed to attach the center beam to the joists of the existing ceiling.

6. The suspended ceiling of claim/wherein the brace is a U-shaped bracket designed to attach the center beam to a flat portion of said existing ceiling.

7. A The suspended ceiling of claim 1 further comprising:

a second rail on the inner side of each ceiling panel diametrically opposed to said first rail; and a pair of channels on the outer side of the center beam extending along the longitudinal dimension of the center beam for accepting said second rail, said second rails designed to further restrict movement of said ceiling panels.

8. The suspended ceiling of claim 1 wherein the perimeter supports, center beam and ceiling panels are made of wood.

9. The suspended ceiling of claim 8 wherein said ceiling panels are made from a single wood sheet.

10. The suspended ceiling of claim 8 wherein said ceiling panels are made from three flat boards secured together.

11. The suspended ceiling of claim 10 wherein a means for securing the flat boards is reversible so that the ceiling panels can be disassembled, one or more of the flat boards can be altered, and the ceiling panel can be reassembled bearing a new appearance.

12. The suspended ceiling of claim 11 wherein an alteration consists of painting or staining.

13. The suspended ceiling of claim 11 wherein an alteration consists of burning or carving a design.

14. The suspended ceiling of claim 8 wherein said ceiling panels are made of a man-made product.

15. The suspended ceiling of claim 14 wherein the man-made product is a wood laminate.

16. The suspended ceiling of claim 14 wherein the man made product is plastic-based solid-surface material.

* * * * *